US006463771B1

(12) United States Patent
Judge

(10) Patent No.: US 6,463,771 B1
(45) Date of Patent: Oct. 15, 2002

(54) SOFT SIDED PORTABLE SAFE CONSTRUCTION

(76) Inventor: Robert Judge, 3280 Enderby Rd., Shaker Heights, OH (US) 44120

( * ) Notice: Subject to any disclaimer, the term of this patent is extended or adjusted under 35 U.S.C. 154(b) by 0 days.

(21) Appl. No.: 09/833,292

(22) Filed: Apr. 13, 2001

(51) Int. Cl.[7] ..... E05B 67/38

(52) U.S. Cl. ..... 70/68; 70/69; 190/120; 190/101

(58) Field of Search ..... 70/67–69; 190/101, 190/102, 120–122

(56) References Cited

U.S. PATENT DOCUMENTS

| | | | | | |
|---|---|---|---|---|---|
| 3,762,345 | A | | 10/1973 | Sgariglia, Jr. | 109/22 |
| 4,397,378 | A | * | 8/1983 | Lee | 190/52 |
| 4,460,092 | A | * | 7/1984 | Lee | 211/4 |
| 4,575,873 | A | * | 3/1986 | Smith | 2/234 |
| 4,733,549 | A | * | 3/1988 | Baker | 70/68 |
| 5,437,367 | A | | 8/1995 | Martin | 206/320 |
| 5,595,073 | A | * | 1/1997 | Sullivan | 70/18 |
| 5,730,009 | A | | 3/1998 | Westfield | 70/63 |
| 6,109,434 | A | | 8/2000 | Howard, Jr. | 206/320 |
| 6,113,268 | A | * | 9/2000 | Thompson | 383/40 |
| 6,161,738 | A | | 12/2000 | Norris | 224/153 |
| 6,308,541 | B1 | * | 10/2001 | Stowe | 70/68 |
| 6,357,086 | B1 | * | 3/2002 | Ye | 24/381 |

* cited by examiner

*Primary Examiner*—Lynne H. Browne
*Assistant Examiner*—John B. Walsh
(74) *Attorney, Agent, or Firm*—Henderson & Sturm LLP

(57) ABSTRACT

A portable safe construction (10) adapted to be attached to a stationary fixed object (60)(70) and including an enclosure member (20) fabricated from ballistic cloth (21) and having a lid element (22) and a receptacle element (24) hingedly connected together and further provided with a zipper element (25) for releasably joining the lid element (22) to the receptacle element (24) which are both provided with lopped panel elements (26)(26') adapted to be threadedly engaged by an elongated cable member (40) which will entirely overlie the zipper element (25) and is further provided with cable outlets (41)(42) that can be joined together by a conventional lock (50).

17 Claims, 2 Drawing Sheets

SOFT SIDED PORTABLE SAFE CONSTRUCTION

CROSS REFERENCE TO RELATED APPLICATIONS

Not applicable.

BACKGROUND OF THE INVENTION

1. Field of the Invention

The present invention relates to the field of secure enclosures in general and in particular to a soft sided portable safe construction that is adapted to be secured to a fixed object.

2. Description of Related Art

As can be seen by reference to the following U.S. Pat. Nos. 5,437,367; 3,762,345; 5,730,009; and, 6,109,434, the prior art is replete with myriad and diverse protective enclosure constructions.

While all of the aforementioned prior art constructions are more than adequate for the basic purpose and function for which they have been specifically designed, they are uniformly deficient with respect to their failure to provide a simple, efficient, and practical soft sided safe construction that includes a novel combined closure and securing arrangement that not only prevents access into the interior of the enclosure, but also allows the enclosure to be securely connected to a stationary object.

While all of the prior art constructions provide a secure enclosure, they do not make any provision with respect to preventing the enclosure from being removed from a particular location.

As a consequence of the foregoing situation, there has existed a longstanding need for a new and improved type of secure portable enclosure that incorporates an enclosure retention means as part of the enclosure securing means; and, the provision of such a construction is the stated objective of the present invention.

BRIEF SUMMARY OF THE INVENTION

Briefly stated, the soft sided portable safe construction that forms the basis of the present invention comprises in general an enclosure unit, a cable unit and an optional hotel safe adapter unit wherein the enclosure unit and the adapter unit are fabricated from ballistic cloth and the cable unit is fabricated from braided steel cable.

As will be explained in greater detail further on in the specification, the enclosure unit includes an enclosure member having a lid element hingedly connected to a receptacle element and provided with a zipper element and a plurality of looped panel elements each having a looped cylindrical portion which is adapted to receive the cable unit and overlie selected portions of the zipper element.

As a result of this arrangement, when the ends of the cable unit are threaded through the looped panel elements and are connected together by a conventional lock, the lid element cannot be disengaged from contact with the receptacle element, even in those instances wherein the zipper element is not operatively employed.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
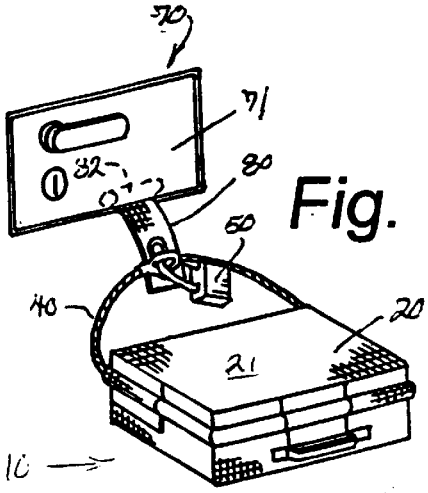
FIG. 1 is a perspective view of the portable safe construction secured to a fixed hotel room safe.
Figure 6:
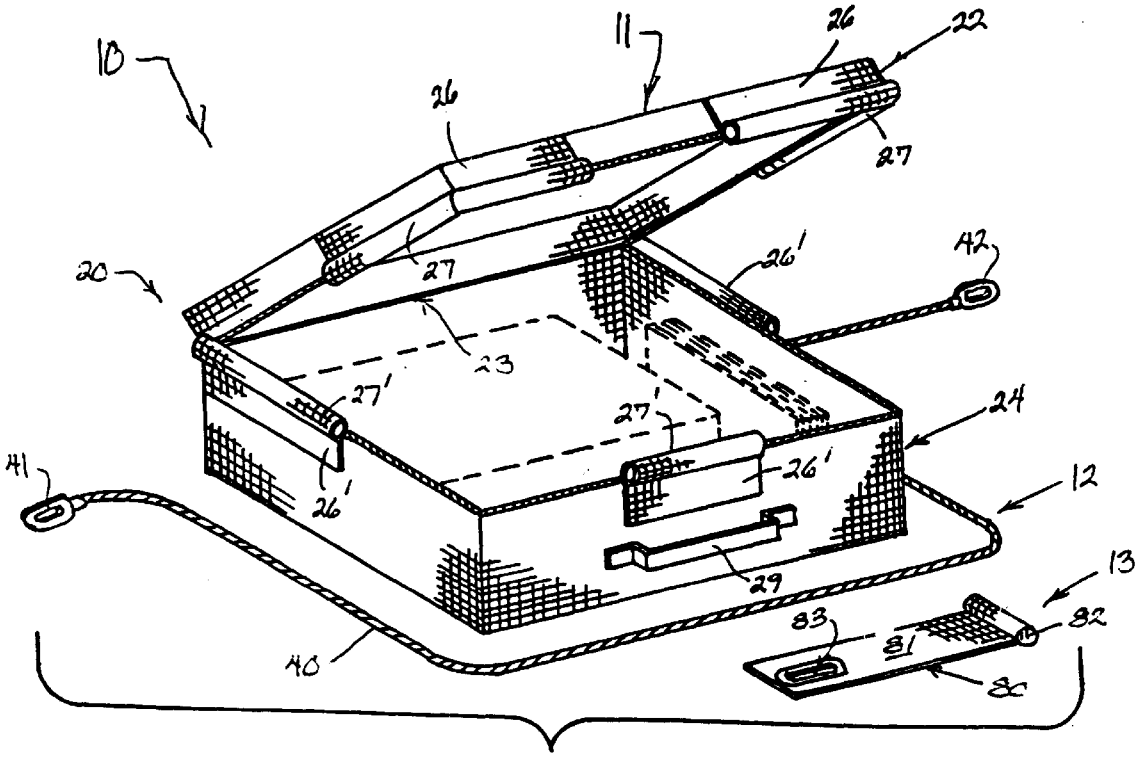
FIG. 6 is a layout view of the various components of the construction.

As can be seen by reference to the drawings, and in particular to FIG. 1, the soft sided portable safe construction that forms the basis of the present invention is designated generally by the reference number 10. Turning now to FIG. 6, it can be seen that the safe construction 10 comprises in general an enclosure unit 11, a cable unit 12 and a hotel safe adapter unit 13. These units will now be described in seriatim fashion.

Figure 3:
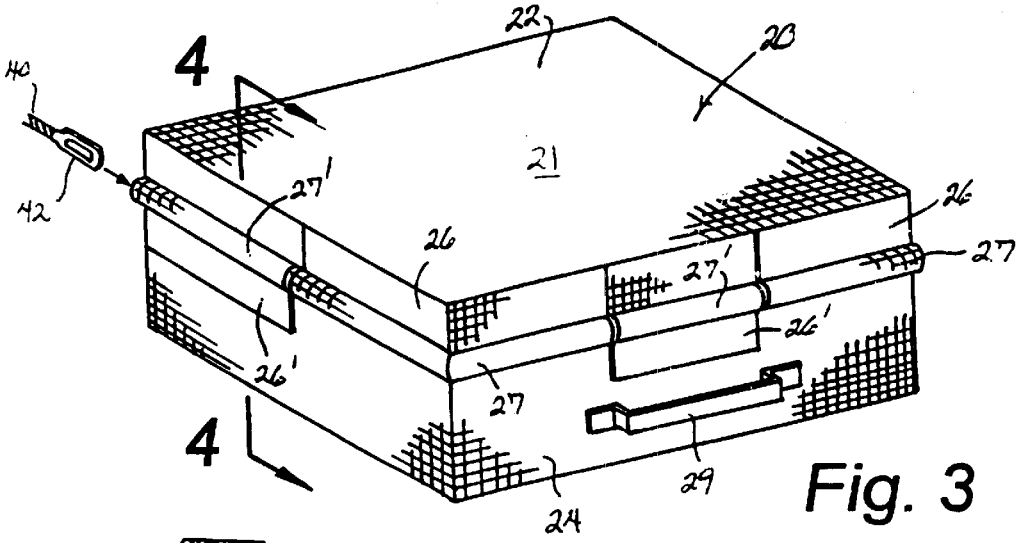
FIG. 3 is a substantially isolated view of the soft sided enclosure unit.

As can best be seen by reference to FIGS. 3 and 6, the enclosure unit 11 comprises a generally rectangular enclosure member 20 fabricated from a ballistic fabric material 21 such as KEVLAR™ or the like and including a lid element 22 hingedly connected on one end as at 23 to the rear of an enlarged receptacle element 24 having a carrying handle 29.

In addition, the enclosure member 20 is further provided with a zipper element 25 that extends around the front and both sides of the enclosure member 20 to form the primary closure between the lid element 22 and the receptacle element 24 of the enclosure member 20.

Figure 7:
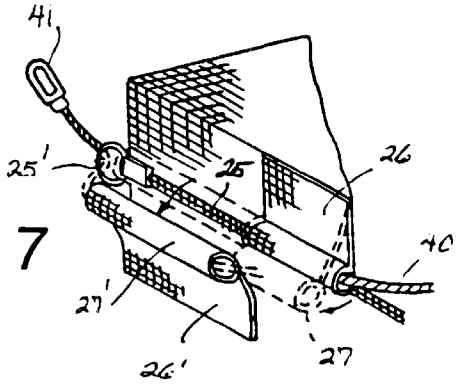
FIG. 7 is an isolated detail view of the cooperation between the cable unit and the zipper and loop portions of the enclosure unit.

As can best be appreciated by reference to FIGS. 6 and 7, both the lid element 22 and the receptacle element 24 are provided with a plurality of looped panel elements 26 26' respectively which are disposed in a staggered end to end relationship to one another wherein each of the panel elements 26 26' is hingedly connected on one end and has a looped cylindrical portion 27 27' formed on the other end.

Figure 4:
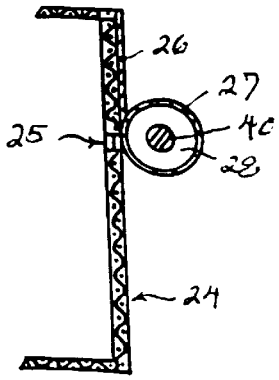
FIG. 4 is a cross sectional view taken through line 4—4 of FIG. 3.
Figure 5:
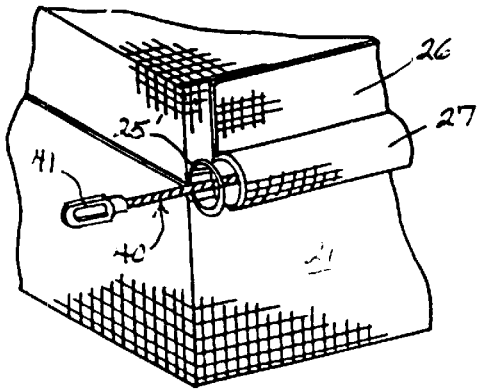
FIG. 5 is an isolated detail view of the threaded engagement between the cable unit and the zipper closure on the enclosure unit.

As shown in FIGS. 3 and 4, when the cylindrical portions 27 27' of the looped panel elements 26 26' are deployed in their operative disposition, they will define a U-shaped segmented generally tubular channel 28 that covers the running length of the zipper element 25 for reasons that will be explained presently.

Turning now to FIGS. 3 through 7, it can be seen that the cable unit 12 comprises an elongated relatively flexible braided steel cable member 40 having a pair of metal eyelets 41 42 fixedly secured to its opposite ends; wherein, the cable member 40 and the metal eyelets 41 42 are dimensioned to be threaded through both the U-shaped channel 28 formed by the looped cylindrical portions 27 27' of the panel elements 26 26' and the pull ring 25' of the zipper 25 for reasons that will be explained presently.

Figure 2:
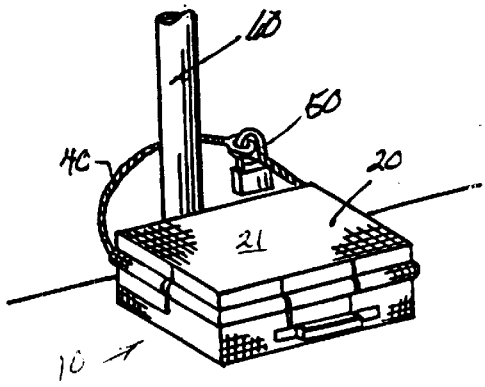
FIG. 2 is a perspective view of the portable safe construction secured to a stationary structure.

In the preferred embodiment of the invention illustrated in FIGS. 1 and 2, the length of the cable member 40 far exceeds the effective length of the peripheral circumference of the enclosure member 20 so that the eyelets 41 42 can be engaged by a conventional lock 50 to captively engage the portable safe construction 10 to a stationary object 60 such as a pole, stanchion, or the like.

It should also be noted at this juncture that in an alternate version of this invention (not shown), the length of the cable member 40 is approximately equal to the peripheral circumference of the enclosure member 20 for those instances wherein the only concern of the user is to have a very secure locking arrangement for the safe construction 10.

Returning once more to FIG. 6, it can be seen that the hotel safe adapter unit 13 comprises a strap member 80 also fabricated from ballistic cloth 81 and provided with a dowel element 82 fixedly secured on one end and a reinforced elongated metal eyelet 83 disposed proximate to but spaced from the other end of the strap member 80.

As shown in FIG. 1, the hotel safe adapter unit 13 is intended for use with a typical hotel safe 70 having a lockable safe closure 71 wherein the capacity of the hotel safe is not great enough to store the enclosure member 20.

In this particular instance, the dowel element 82 of the strap member 80 is placed within the confines of the hotel safe 70 with the eyelet 83 disposed outside of the safe 70 when the safe closure 71 is engaged. Then the eyelet 83 can be threadedly engaged by either of the cable eyelets 41 42 or the lock 50 to captively engage the enclosure member 20 to the strap member 80 in a well recognized fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A portable safe construction adapted for use with stationary fixed objects wherein the safe construction comprises:

an enclosure unit including an enclosure member having a lid element hingedly secured to a receptacle element wherein the lid and receptacle elements are further provided with a zipper element having a pull ring cooperating means provided on both the lid element and the receptacle element of the enclosure member for covering at least selected portions of the zipper element a cable unit including an elongated cable member adapted to threadedly engage said cooperating means and dimensioned to cover the entire length of the zipper element, wherein the elongated cable member has opposite ends provided with eyelets that are adapted to be joined together by a conventional lock.

2. The safe construction as in claim 1; wherein both the enclosure unit and the cooperating means are fabricated from ballistic cloth.

3. The safe construction as in claim 1; wherein, said cooperating means comprises a plurality of looped panel elements having a first end hingedly connected to selected portions of the enclosure member and having a second end defining a looped cylindrical portion dimensioned to threadedly receive said cable member and said cable eyelets.

4. The safe construction as in claim 3; wherein, said zipper element is provided with a pull ring and said cable member and cable eyelets are dimensioned to pass through said pull ring.

5. The safe construction as in claim 4; wherein, the length of the cable member is substantially greater than the peripheral circumference of the enclosure member.

6. The safe construction as in claim 4; wherein, the length of the cable member is approximately equal to the peripheral circumference of the enclosure member.

7. The safe construction as in claim 5; wherein, both the enclosure unit and the cooperating means are fabricated from ballistic cloth.

8. The safe construction as in claim 6; wherein, both the enclosure unit and the cooperating means are fabricated from ballistic cloth.

9. The safe construction as in claim 3; wherein, said plurality of looped panel elements are disposed in an alternating sequential fashion on the lid element and the receptacle element of the enclosure member.

10. The safe construction as in claim 9; wherein, said plurality of looped panel elements are adapted to be disposed in an end to end fashion relative to one another.

11. The safe construction as in claim 9; wherein, the looped generally cylindrical portions of said plurality of looped panel elements define a generally U-shaped channel that covers at least a substantial portion of the zipper element.

12. The safe construction as in claim 10; wherein, the looped cylindrical portions of said plurality of looped panel elements define a generally U-shaped channel that covers the entire length of the zipper element.

13. The safe construction as in claim 9; wherein both the enclosure unit and the cooperating means are fabricated from ballistic cloth.

14. The safe construction as in claim 10; wherein, both the enclosure unit and the cooperating means are fabricated from ballistic cloth.

15. The safe construction as in claim 1 further comprising a hotel safe adapter unit including a strap member having one end provided with a dowel element and the other end provided with a reinforced eyelet.

16. The safe construction as in claim 15; wherein, the reinforced eyelet is dimensioned to receive the cable member.

17. The safe construction as in claim 16; wherein, both the enclosure member and the strap member are fabricated from ballistic cloth.

* * * * *